US006745811B1

(12) United States Patent
Nien

(10) Patent No.: US 6,745,811 B1
(45) Date of Patent: Jun. 8, 2004

(54) COMBINATION WINDOW COVERING

(75) Inventor: Ming Nien, Changhua Hsien (TW)

(73) Assignee: Nien Made Enterprise Co., Ltd., Taichung (TW)

( * ) Notice: Subject to any disclaimer, the term of this patent is extended or adjusted under 35 U.S.C. 154(b) by 0 days.

(21) Appl. No.: 10/431,526

(22) Filed: May 8, 2003

(30) Foreign Application Priority Data

Mar. 17, 2003 (TW) ..... 92204048 U

(51) Int. Cl.[7] ..... E06B 9/08
(52) U.S. Cl. ..... 160/121.1; 160/84.05
(58) Field of Search ..... 160/121.1, 84.05, 160/89, 85, 86, 176.1 R

(56) References Cited

U.S. PATENT DOCUMENTS 2,110,145 A * 3/1938 Loehr ..... 160/89
2,914,122 A * 11/1959 Pinto ..... 160/89
2,994,370 A * 8/1961 Pinto ..... 160/89
5,419,385 A 5/1995 Vogel et al. ..... 160/121.1
5,680,891 A * 10/1997 Prince ..... 160/84.05
6,688,370 B1 * 2/2004 Nien ..... 160/121.1

* cited by examiner

*Primary Examiner*—David Purol
(74) *Attorney, Agent, or Firm*—Bacon & Thomas, PLLC

(57) ABSTRACT

A combination window covering is constructed to include an elongated barrel fastened rolatably with a top side of a window, a bottom rail below the barrel, slats arranged in parallel between the barrel and the bottom rail, front and back ladder tapes connected in parallel between the barrel and the bottom rail at front and back sides of the slats and joining the slats, and a light-admitting flexible sheet. The flexible sheet has first and second ends respectively fixedly fastened to the barrel at two sides, a front half extended from the first end and suspended at the front side of the slats, a back half extended from the second end and suspended at the back side of the slats, and a middle part connected between the front half and the back half and moveably passing over the bottom rail.

7 Claims, 5 Drawing Sheets

COMBINATION WINDOW COVERING

BACKGROUND OF THE INVENTION

1. Field of the Invention

The present invention relates generally to a window covering and, more particularly, to a combination window covering which comprises a blind and a pair of non-opaque flexible sheets at front and back sides of the blind.

2. Description of the Related Art

FIGS. 6 and 7 are perspective (in an extended condition) and side views of a combination window covering according to the prior art. This structure of combination window covering 90 comprises a barrel 91 fastened transversely pivotally with the top side of the window and rotatable by hand or a motor drive, a bottom rail 92 suspending below the barrel 91, a plurality of flexible slats 93 arranged in parallel between the barrel 91 and the bottom rail 92, two pairs of ladder tapes 94 bilaterally joining the flexible slats 93, the ladder tapes 94 including two front ladder tapes 95 connected between the barrel 91 and the bottom rail 92 and joining the flexible slats 93 at the front side and two back ladder tapes 96 connected between the barrel 91 and the bottom rail 92 and joining the flexible slats 93 at the back side, and a pair of non-opaque flexible sheets (for example, meshed fabrics) 97A and 97B respectively provided at the front and back sides of the flexible slats 93 and connected between the barrel 91 and the bottom rail 92. The non-opaque flexible sheets 97A and 97B are rectangular sheet members fitting the size of the window (the non-opaque flexible sheets 97A and 97B are not bonded to the flexible slats 93; however, there are known combination blinds, for example, U.S. Pat. No. 5,419,385, in which the flexible sheets are respectively bonded to the flexible slats).

By means of the aforesaid arrangement, the flexible sheets 97A and 97B vaguely cover the slats 93 at the front and back sides, showing a particular light shading effect quite different from conventional blinds. This design of combination window covering builds up an elegant and graceful style. The user can regulate the light passing through the combination window covering 90 by rotating the barrel 91 through an angle to move the front ladder tape 95 and the back ladder tapes 96 longitudinally in reversed directions. When continuously rotating the barrel 91, the barrel 91 will roll up the flexible slats 93 and the flexible sheets 97A and 97b (see FIG. 8) to the top side of the window or to a particular elevation covering the upper part of the window.

The aforesaid combination window covering 90 is still not satisfactory in function. When the user rolling up the combination window covering 90 from its fully extended position (in the direction as shown in FIG. 8), the upper part of the back flexible sheet 97B will be rolled up by the barrel 91 prior to the front flexible sheet 97A. and, the back flexible sheet 97B will be covered on the front flexible sheet 97A over the periphery of the barrel 91, i.e., the diameter of the back flexible sheet 97B is greater than the front flexible sheet 87A when rolled up. Because the flexible sheets 97A and 97B have the same length and are rolled up at a different start point, the back flexible sheet 97B is smoothly stretched between the barrel 91 and the bottom rail 92 when the combination window covering 90 rolled up. At this time, the front flexible sheet 97A has a curved lower part 98 suspending below the bottom rail 92 at the front side, destroying the sense of beauty of the received status of the combination window covering 90.

It is therefore desirable to provide a combination window covering that eliminates the aforesaid drawback.

SUMMARY OF THE INVENTION

It is the primary object of the present invention to provide a combination window covering, which keeps the front and back flexible sheets in a well-balanced status, causing a sense of beauty.

To achieve this object of the present invention, the combination window covering comprises an elongated barrel fastened rotatably with a top side of a window for free rotation on an axis thereof; a bottom rail arranged in parallel to and spaced below the barrel; a plurality of slats arranged in parallel between the barrel and the bottom rail; front and back ladder tapes connected in parallel between the barrel and the bottom rail at front and back sides of the slats and joining the slats, and a light-admitting flexible sheet. The flexible sheet has first and second ends respectively fixedly fastened to the barrel at two sides, a front half extended from the first end and suspended at the front side of the slats, a back half extended from the second end and suspended at the back side of the slats, and a middle part connected between the front half and the back half and moveably passing over the bottom rail.

DETAILED DESCRIPTION OF THE INVENTION

Figure 1:
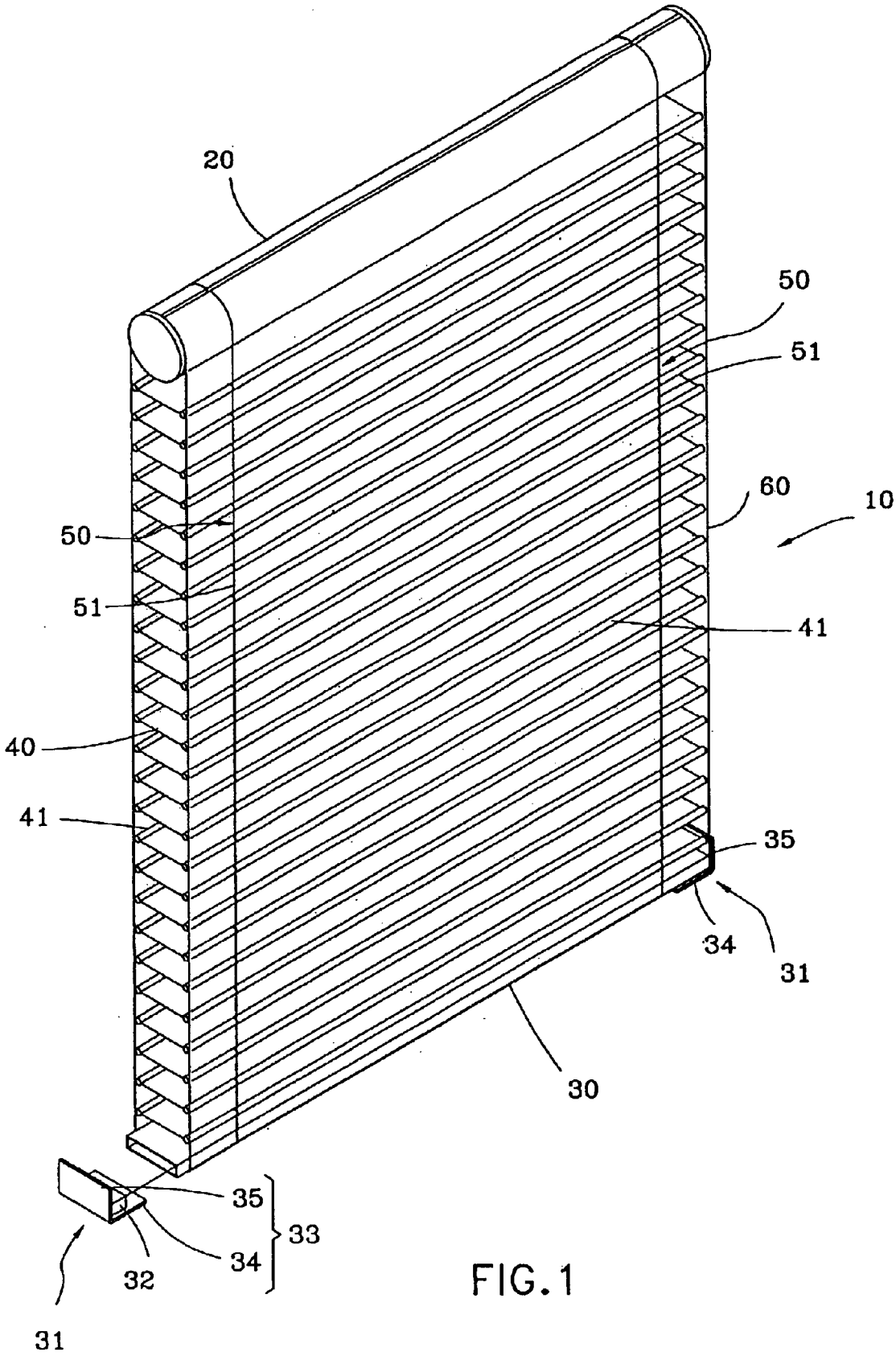
FIG. 1 is a perspective view, in an extended condition, of a combination window covering according to a preferred embodiment of the present invention.
Figure 2:
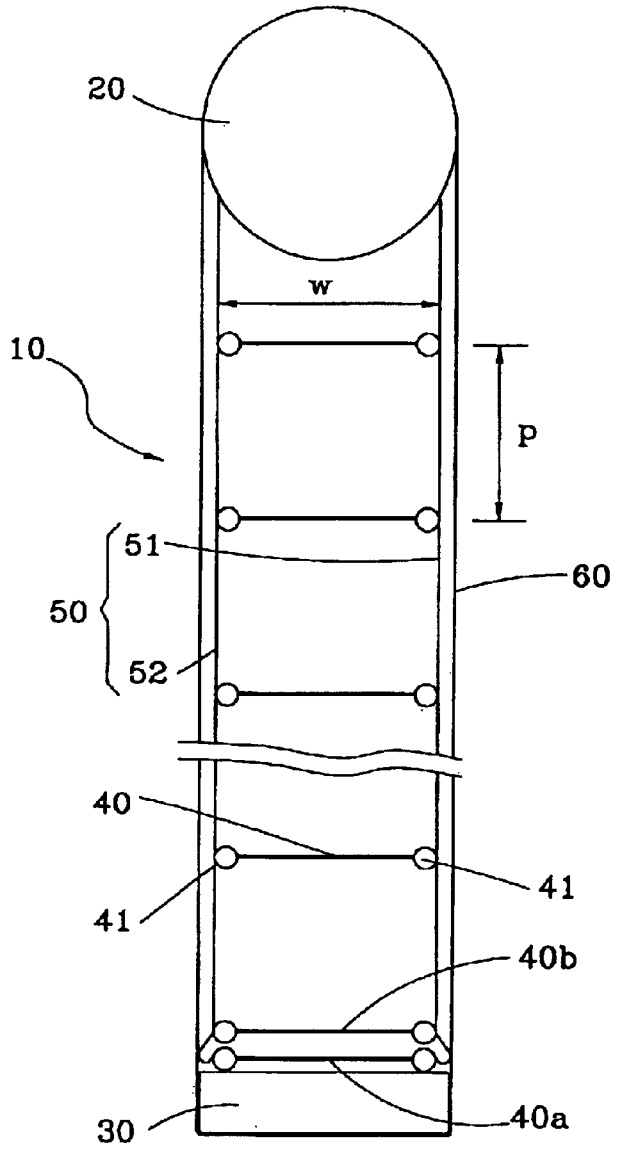
FIG. 2 is a left side view of the combination window covering according to the preferred embodiment of the present invention.
Figure 3:
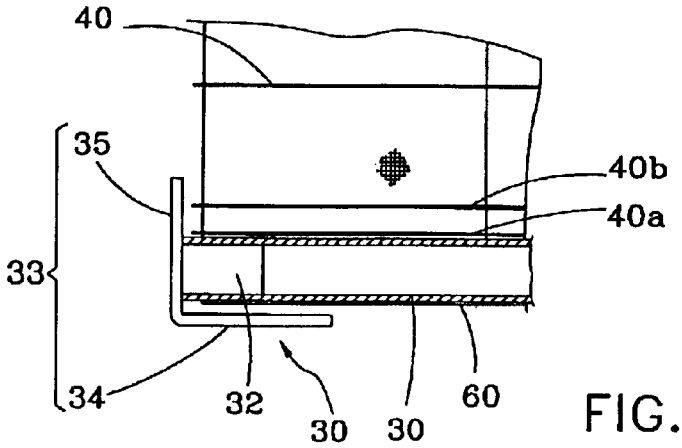
FIG. 3 is a front view of a part of the combination window covering around one end of the bottom rail according to the preferred embodiment of the present invention.

Referring to FIGS. 1–3, a combination window covering 10 in accordance with a preferred embodiment of the present invention is shown comprised of a barrel 20, a bottom rail 30, a plurality of flexible slats 40, two pairs of ladder tapes 50, and a flexible sheet 60.

The barrel 20 is a hollow cylindrical member having a length approximately equal to the transverse width of the window in which the combination window cover 10 is to be installed. According to the present invention, the barrel 20 is fastened rotatably with the top side of the window in transverse (horizontal) direction, and can be rotated on its own axis by the user (through a lift cord, or a wire-controlled and/or remote-controlled motor drive; the rotation control of the barrel is of the known art and not within the scope of the claims of the present invention, no further detailed description in this regard is necessary).

The bottom rail 30 is shaped like an elongated flat box arranged in parallel to and suspended below the barrel 20. The length of the bottom rail 30 is approximately equal to the transverse width of the window. The width of the bottom rail 30 is approximately equal to the diameter of the barrel 20. The bottom rail 30 is a heavy member made of metal (for example, extruded from aluminum), having two end caps 31 respectively disposed at the two distal open ends. The end caps 31 each comprise a plug 32, which is plugged into one open end of the bottom rail 30, and an angle plate 33 fixedly fastened to the plug 32 at an outer side. The angle plate 33 has a horizontal bearing wall 34 disposed in parallel to the bottom wall of the bottom rail 30, and a vertical stop wall 35 protruding over the top side of the bottom rail 30 at a distance and extending in direction perpendicular to the bottom rail 30.

The flexible slats 40 are narrow, elongated, rectangular members made of fabric. The length of the flexible slats 40 is approximately equal to the transverse width of the window. The width of the flexible slats 40 is slightly smaller than the diameter of the barrel 20. Each slat 40 has two long sides hemmed and embedded with a respective rod member 41. The rod members 41 of each slat 40 keep the length of the respective slat 40 in shape, allowing the respective slat 40 to be curved in transverse direction. The flexible slats 40 are arranged in parallel between the barrel 20 and the bottom rail 30 at different elevations.

The two pairs of ladder tapes 50 are symmetrically bilaterally fastened to the flexible slats 40, including two front ladder tapes 51 connected between the barrel 20 and the bottom rail 30 and joining the flexible slats 40 at the front side and two back ladder tapes 52 connected between the barrel 20 and the bottom rail 30 and joining the flexible slats 40 at the back side (according to the present preferred embodiment, the front ladder tapes 51 and the back ladder tapes 52 are respectively tied to the rod member 41 of the flexible slats 40, however any of a variety of conventional bonding methods may be used). By means of the ladder tapes 50, the bottom rail 30 and the flexible slats 40 are suspended below the barrel 20. As illustrated in FIG. 2, the flexible slats 40 are arranged in parallel at different elevations and equally spaced from one another. The pitch P between each two adjacent flexible slats 40 (i.e., the length of each front ladder tape 51 or back ladder tape 52 between two adjacent flexible slats 40) is slightly smaller than the width (the length of the short sides) W of the flexible slats 40. Further, the lowest flexible slat 40*a* is closely suspended on the top surface of the bottom rail 30; the vertical stop walls 35 of the angle plates 33 of the end caps 31 are respectively stopped against the left and right ends of the lowest two flexible slats 40*a* and 40*b*, keeping the left and right ends of the lowest two flexible slats 40*a* and 40*b* in position respectively.

The flexible sheet 60 is a rectangular piece of thin layer of meshed fabric that admits light. The length of the flexible sheet 60 is about twice of the longitudinal length of the window. The width of the flexible sheet 60 is approximately equal to the transverse width of the window. About one half of the flexible sheet 60 measured in longitudinal direction (the area corresponding to the dimensions of the window) is covered over the flexible slats 40 at the front side. The middle part of the flexible sheet 60 extends over the bottom side of the bottom rail 30 and supported on the horizontal bearing walls 34 of the angle plates 33 of the end caps 31 (see FIG. 3). The other half of the flexible sheet 60 is covered over the flexible slats 40 at the back side. Further, the two distal ends (the top ends of the front and rear halves) of the flexible sheet 60 are respectively fixedly fastened to the periphery of the barrel 20 at two sides. The length of the flexible sheet 60 fits the ladder tapes 50 so that the bottom rail 30 is maintained pressed on the middle part of the flexible sheet 60. In order to let the bottom rail 30 be pressed on the middle part of the flexible sheet 60, the ladder tapes 50 is made slightly longer than the longitudinal length of the flexible sheet 60. Thus, the bottom ends of the ladder tapes 50 are not fully extended out when the combination window covering 10 set in the fully extended position (see FIG. 2), i.e., the front ladder tapes 51 and the back ladder tapes 52 are not stretched straight at the area between the lowest flexible slat 40*a* and the second lowest flexible slat 40*b*.

When the user rotating the barrel 20 forwards (clockwise rotation in FIG. 2) or backwards, the flexible sheet 60, the ladder tapes 50 and the flexible slats 40 are rolled up around the periphery of the barrel 20, or lowered from the barrel 20 and extended out. When the bottom rail 30 lowered to the lower limit position, the flexible slats 40 are equally spaced from one another at different elevations over the whole area of the window. When the user continuously rotate the barrel 20 forwards or backwards through an angle after the bottom rail 30 has been lowered to the lower limit position, the light shading status of the combination window covering 10 is relatively adjusted. The aforesaid function is similar to conventional designs. As indicated above, the flexible sheet 60 extends over the bottom side of the bottom rail 30 and, the bottom rail 30 is pressed on the middle part of the flexible sheet 60, therefore the front and rear halves of the flexible sheet 60 are maintained in a stretched and fully expanded status at the front and back sides of the flexible slats 40, causing a sense of beauty.

Figure 4:
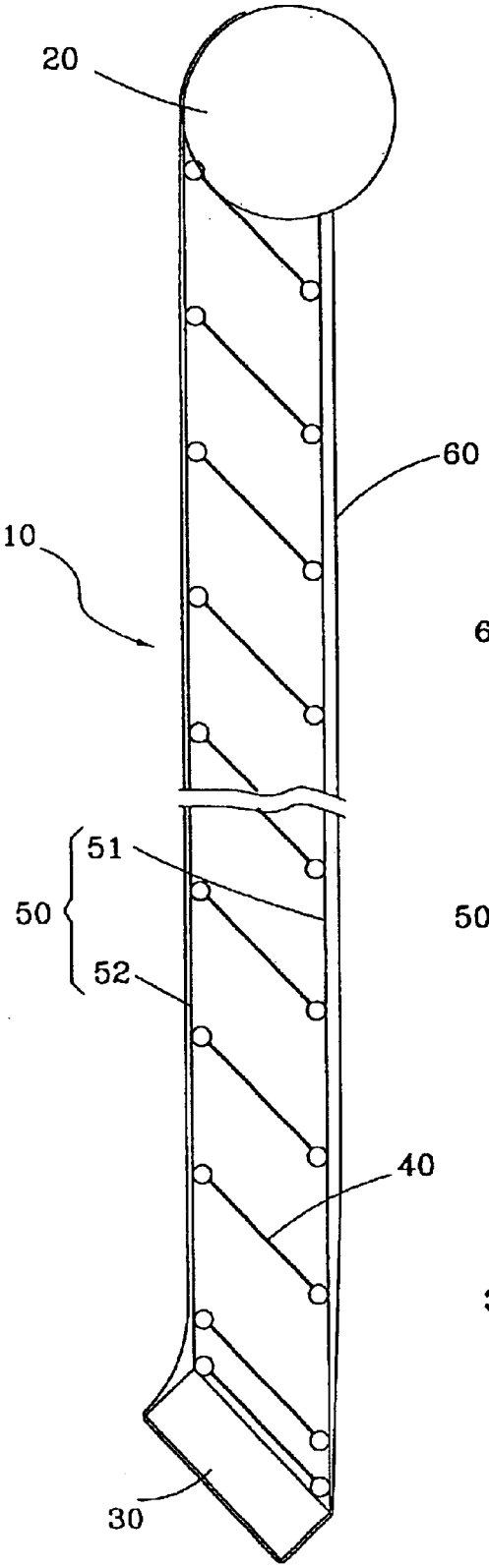
FIG. 4 is a left side view of the preferred embodiment of the present invention showing a status of the combination window covering where the combination window covering is going to be rolled up from the fully extended position.
Figure 5:
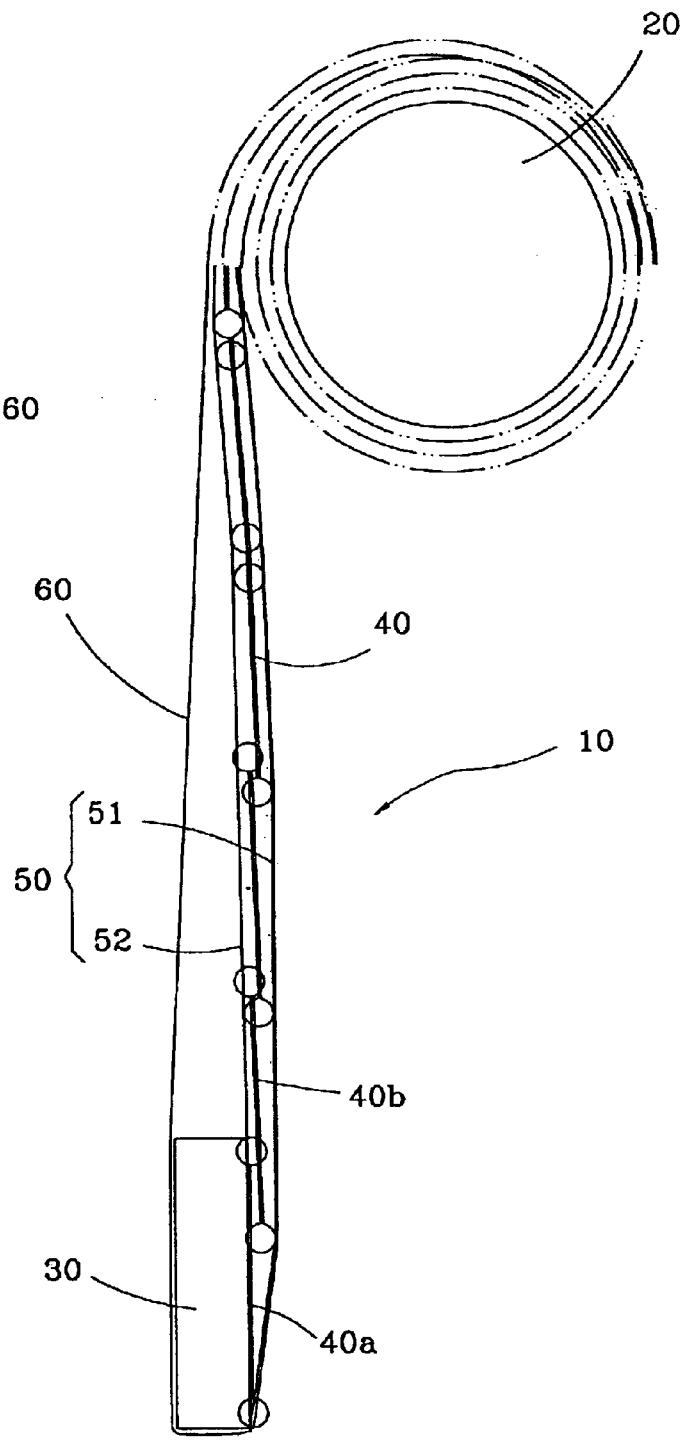
FIG. 5 is a left side view in an enlarged scale of the preferred embodiment of the present invention, showing the combination window covering rolled up.
Figure 6:
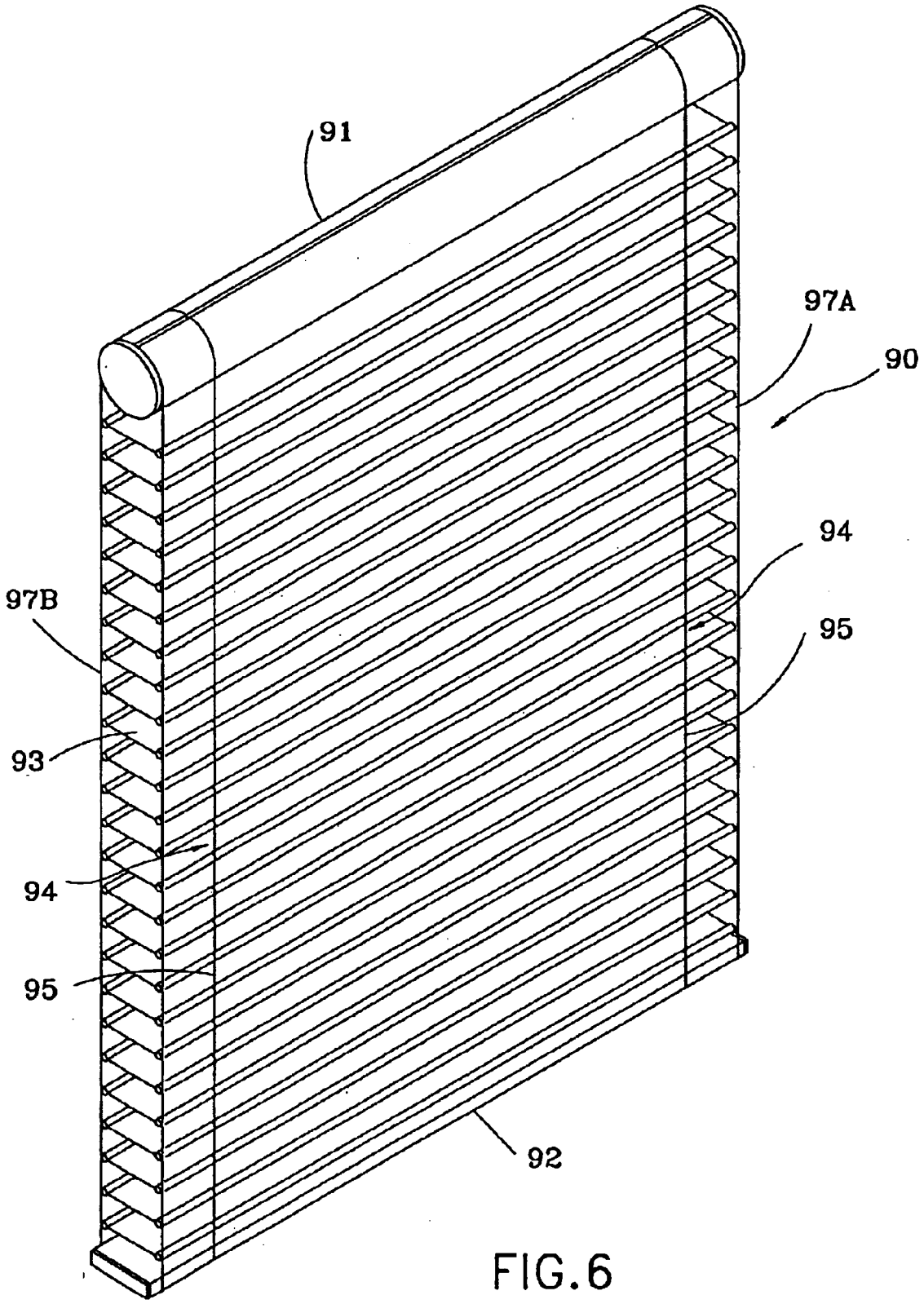
FIG.6 PRIOR ART
FIG. 6 is a perspective view, in an extended condition, of a combination window covering according to a prior art.
Figure 7:
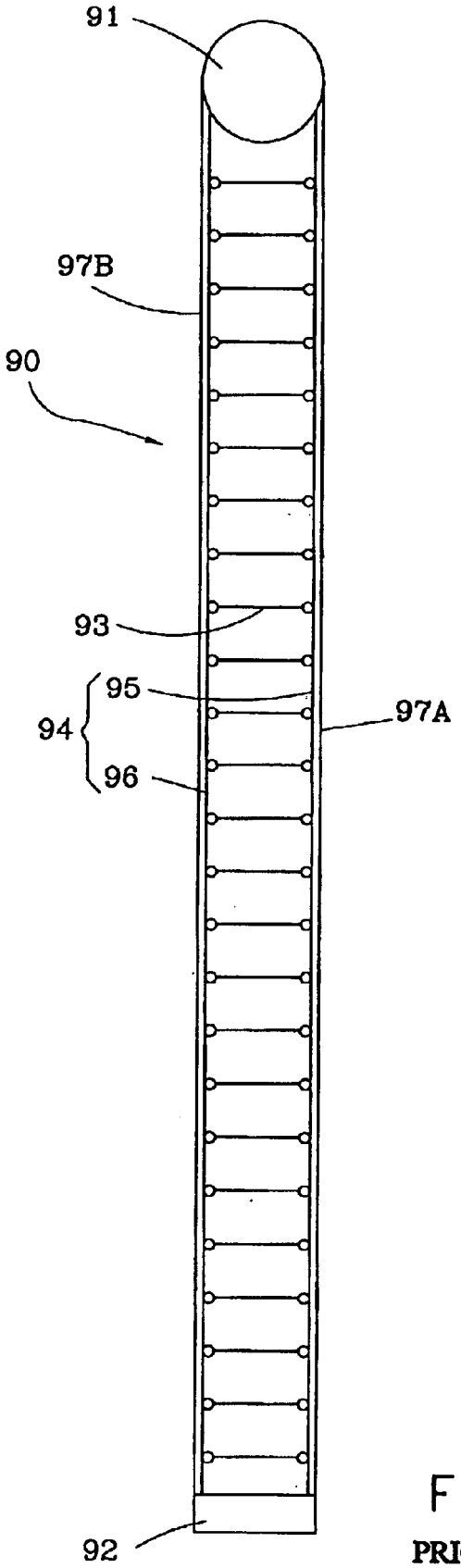
FIG.7 PRIOR ART
FIG. 7 is a side view of the combination window covering according to the prior art.
Figure 8:
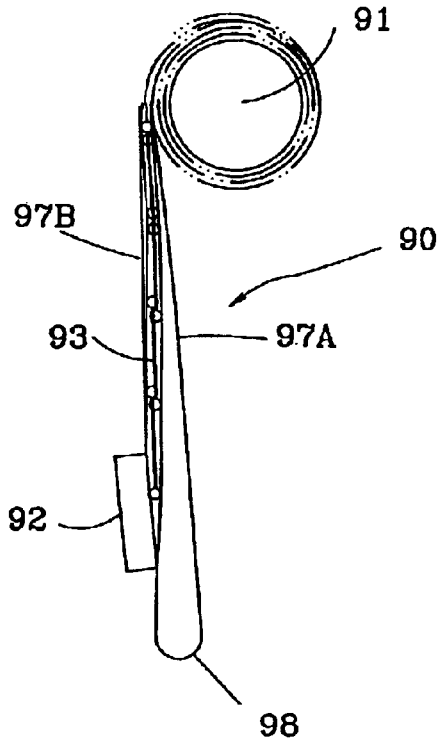
FIG.8 PRIOR ART
FIG. 8 is a schematic drawing showing the received status of the prior art combination window covering.

When the user rotating the barrel 20 forwards after the combination window covering 10 has been fully extended out (for example, when adjusting the tilting angle of the flexible slats or rolling up the combination window covering) as shown in FIG. 4, the top side of the front half of the flexible sheet 60 will be lowered to the bottom side of the barrel 20, and the upper part of the back half of the flexible sheet 60 will be overlaid on the periphery of the barrel 20. When continuously rotating the barrel 20 forwards as shown in FIG. 5, the front and back halves of the flexible sheet 60 and the flexible slats 40 are rolled up around the barrel 20 from the back side. Because the flexible sheet 60 is not fixedly fastened to the flexible slats 40 and the bottom rail 30, the middle part of the flexible sheet 60 is movable relative to the bottom rail 30 to automatically adjust the area of the front half and the area of the back half of the flexible sheet 60, keeping the face of the flexible sheet 60 in a smooth condition at the front and back sides of the flexible slats 40 without wrinkles.

Further, the horizontal bearing walls 34 of the angle plates 33 of the end caps 31 support the middle part of the flexible sheet 60 below the bottom rail 30 and the vertical stop walls 35 of the angle plates 33 of the end caps 31 are respectively stopped against the left and right ends of the lowest two flexible slats 40*a* and 40*b*, the combination window covering 10 is maintained smooth when adjusting. The design of the width W of the flexible slats 40 to be slightly greater than the pitch P of the flexible slats 40 assures the rod member 41 at the top side of one lower flexible slat (the back side of the respective flexible slat when in horizontal) to be slightly higher than the rod member 41 at the bottom side (the front side of the respective flexible slat when in horizontal) of the adjacent upper flexible slat as shown in FIG. 5, preventing abutting of one rod member 41 against another in horizontal direction and, enabling the flexible slats 40 to be smoothly rolled up around the periphery of the barrel 20. Further, keeping one flexible slat 40 in close contact with the top surface of the bottom rail 30 causes a sense of beauty.

Although a particular embodiment of the invention has been described in detail for purposes of illustration, various modifications and enhancements may be made without departing from the spirit and scope of the invention. For example, an insertion slot may be extended through the front and back sides of the bottom rail for the passing of the flexible sheet such that the middle part of the flexible sheet has not to pass around the bottom side of the bottom rail as shown in the above-mentioned preferred embodiment. Accordingly, the invention is not to be limited except as by the appended claims.

What is claimed is:

1. A combination window covering comprising:

an elongated barrel fastened rotatably with a top side of a window for free rotation on an axis thereof;

a bottom rail arranged in parallel to and spaced below said barrel;

a plurality of slats arranged in parallel between said barrel and said bottom rail;

at least two pairs of ladder tapes, each pairs of the ladder tapes including a front ladder tape and a back ladder tape respectively longitudinally connected between said barrel and said bottom rail at front and back sides of said slats and joining said slats; and a light-admitting flexible sheet having first and second ends respectively fixedly fastened to said barrel at two sides, a front half extended from said first end and suspended at the front side of said slats, a back half extended from said second end and suspended at the back side of said flexible slats, and a middle part connected between said front half and said back half and moveably passing over said bottom rail.

2. The combination window covering as claimed in claim 1, wherein said bottom rail has the bottom side pressed on the middle part of said flexible sheet.

3. The combination window covering as claimed in claim 2, wherein said bottom rail is provided with two horizontal bearing walls respectively extended from two distal ends thereof and adapted to support the middle part of said flexible sheet below said bottom rail.

4. The combination window covering as claimed in claim 3, wherein said bottom rail is an elongated flat box having two end caps respectively fastened to the two distal ends, said end caps each comprising a plug press-fitted into one distal end of said bottom rail and an angled plate fixedly fastened to said plug, said angled plate having a vertical stop wall stopped at one end of each of two lowest ones of said and a part forming one of said horizontal bearing walls.

5. The combination window covering as claimed in claim 1, wherein said bottom rails has two vertical stop walls respectively extended from two distal ends thereof and respectively stopped at opposite ends of two lowest ones of said slats.

6. The combination window covering as claimed in claim 1, wherein said bottom rail has an elongated insertion slot extended through front and back sides thereof for passing of the middle part of said flexible sheet.

7. The combination window covering as claimed in claim 1, wherein said slats each have two long sides, two rod members respectively embedded in the two long sides and respectively tied to said front and back ladder tapes; said flexible slats have a width relatively greater than the pitch between each two adjacent ones of said flexible slats.

* * * * *